US005246385A

United States Patent [19]

Chida et al.

[11] Patent Number: 5,246,385

[45] Date of Patent: Sep. 21, 1993

[54] CONNECTOR AND METHOD OF MANUFACTURE THEREOF

[75] Inventors: Yoshifumi Chida; Mituaki Hayashi; Atsushi Kikuchi; Kenichi Hatakeyama, all of Iwate, Japan

[73] Assignee: NEC Corporation, Japan

[21] Appl. No.: 842,462

[22] Filed: Feb. 27, 1992

[30] Foreign Application Priority Data

Feb. 27, 1991 [JP] Japan ..... 3-032550

[51] Int. Cl.[5] ..... H01R 13/648

[52] U.S. Cl. ..... 439/607; 439/886; 439/931

[58] Field of Search ..... 439/607-610, 439/686, 701, 886, 931, 901, 904, 78, 79

[56] References Cited

U.S. PATENT DOCUMENTS 3,551,874 12/1970 Volinskie ..... 439/931 X
3,605,075 9/1971 Stofkooper ..... 439/931 X
4,685,761 8/1987 Locati ..... 439/843
4,986,779 1/1991 Ferrill et al. ..... 439/931 X
5,035,649 7/1991 Collier et al. ..... 439/607
5,088,009 2/1992 Harada et al. ..... 439/931 X

*Primary Examiner*—Larry I. Schwartz
*Assistant Examiner*—Khiem Nguyen
*Attorney, Agent, or Firm*—Laff, Whitesel, Conte & Saret

[57] ABSTRACT

A connector comprises a socket portion which is subjected to surface treatment and a base portion which is not subjected to the surface treatment, or comprises a socket portion and a base portion subjected to different kinds of surface treatments. The socket and base portions are each provided with a coupling mechanism. The socket and base portions may be easily surface treated independently, after which they are coupled together, thereby forming a connector capable of preventing short circuit arising from surface treatments.

3 Claims, 2 Drawing Sheets

CONNECTOR AND METHOD OF MANUFACTURE THEREOF

FIELD OF THE INVENTION

The invention relates to a connector partially subjected to surface treatment or having portions subjected to at least two different kinds of surface treatments, and to a method of manufacturing said connector.

BACKGROUND OF THE INVENTION

Conventional connectors for use in coupling electric/electronic circuit boards with external units for transferring signals between the boards and units are formed of terminal securing portions and housing portions which are integral with the terminal securing portions and made of insulating materials such as plastics.

In order to prevent dissipation of signals or electromagnetic waves from naked conducting portions of the connectors and to prevent resultant noise problems caused by the leakage of the electromagnetic waves, these connectors are subjected to surface treatment such as electroplating or metal-vapor deposition.

However, if a whole connector is surface treated, its terminals, and hence the circuit on the board, can be short-circuited or electrically connected by a metal film formed in such surface treatment, causing serious disadvantages.

In order to prevent such short-circuiting of the circuit, those portions that must not be surface-treated are conventionally masked with masking tape prior to the surface treatment.

This conventional method, however, requires a tedious process of masking the surface in conformity with fine configurations of the connector, which lowers manufacturing efficiency and increases manufacturing cost.

SUMMARY OF THE INVENTION

The invention is directed to overcome these disadvantages pertinent to prior art. It is, therefore, a primary object of the invention to provide a connector which may be manufactured efficiently, and a method of manufacture thereof.

Therefore, in a first aspect of the invention, there is provided a connector, comprising a first portion which is subjected to a surface treatment, and a second separate portion which is not subjected to the surface treatment, said first and second portions each being provided with connection mechanisms for coupling the first and second portions together, said first portion being surface treated.

Since the first portion of the connector alone may be surface treated, it is not needed to mask the second portion with tapes, thereby improving workability of the connector in the manufacture.

In a second aspect of the invention, there is provided a connector made up of a multiplicity of separate portions which are subjected to surface treatment, said portions each provided with coupling mechanisms for coupling said portions together.

With this configuration each of said multiple portions may be surface treated independently for different surface treatments, thereby improving manufacture yield.

In a third aspect of the invention, there is provided a connector made up of first portions subjected to surface treatment and second portions not subjected to the surface treatment, wherein said first portions are connected, after said surface treatment, with the second portions.

Since said first portions are surface treated separately from said second portions, masking of the second portions is no longer needed, allowing the connector to be manufactured in a simple manner. Each of the first and second portions is preferably provided with a coupling mechanism for coupling the portions together. This allows the elimination of special coupling mechanisms and reduction of cost.

In a fourth aspect of the invention, there is provided a method of manufacturing a connector made up of a multiplicity of portions subjected to separate surface treatments, wherein said portions are connected with each other, after said surface treatments.

Since said portions are surface treated separately as needed, the connector may be manufactured in a simple manner.

Each of these portions is preferably provided with a coupling mechanism for coupling the portions together. This allows the elimination of special coupling mechanisms and reduction of cost of the connector.

BRIEF DESCRIPTION OF THE DRAWINGS

FIG. 1(*b*) is a perspective view of the connector shown in FIG. 1(*a*), illustrating how it is mounted on a circuit board.

FIG. 2(*b*) is a perspective view of the connector shown in FIG. 2(*a*), illustrating how it is mounted on a circuit board.

DETAILED DESCRIPTION OF THE PREFERRED EMBODIMENT

The invention is now described by way of examples.

Figure 1A:
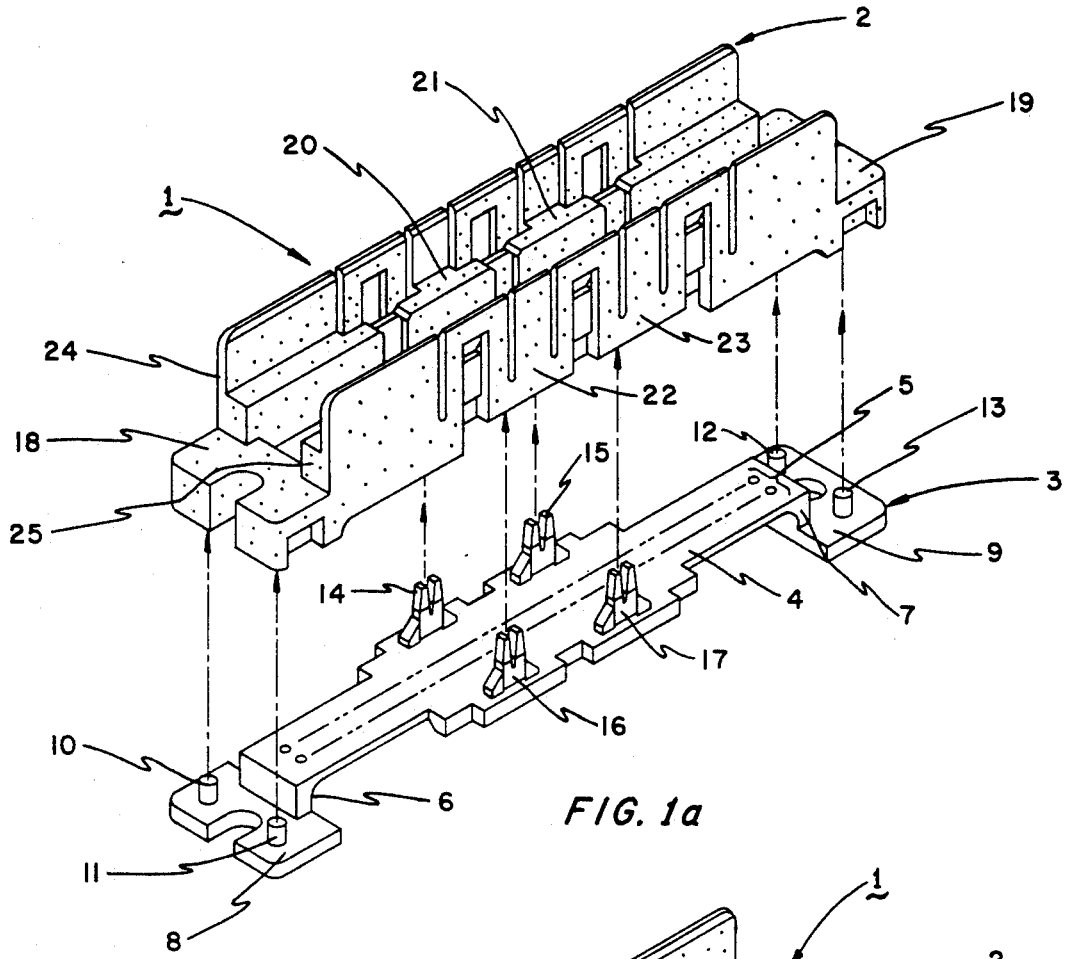
FIG. 1(*a*) is a schematic perspective view of a connector embodying the invention.
Figure 1B:
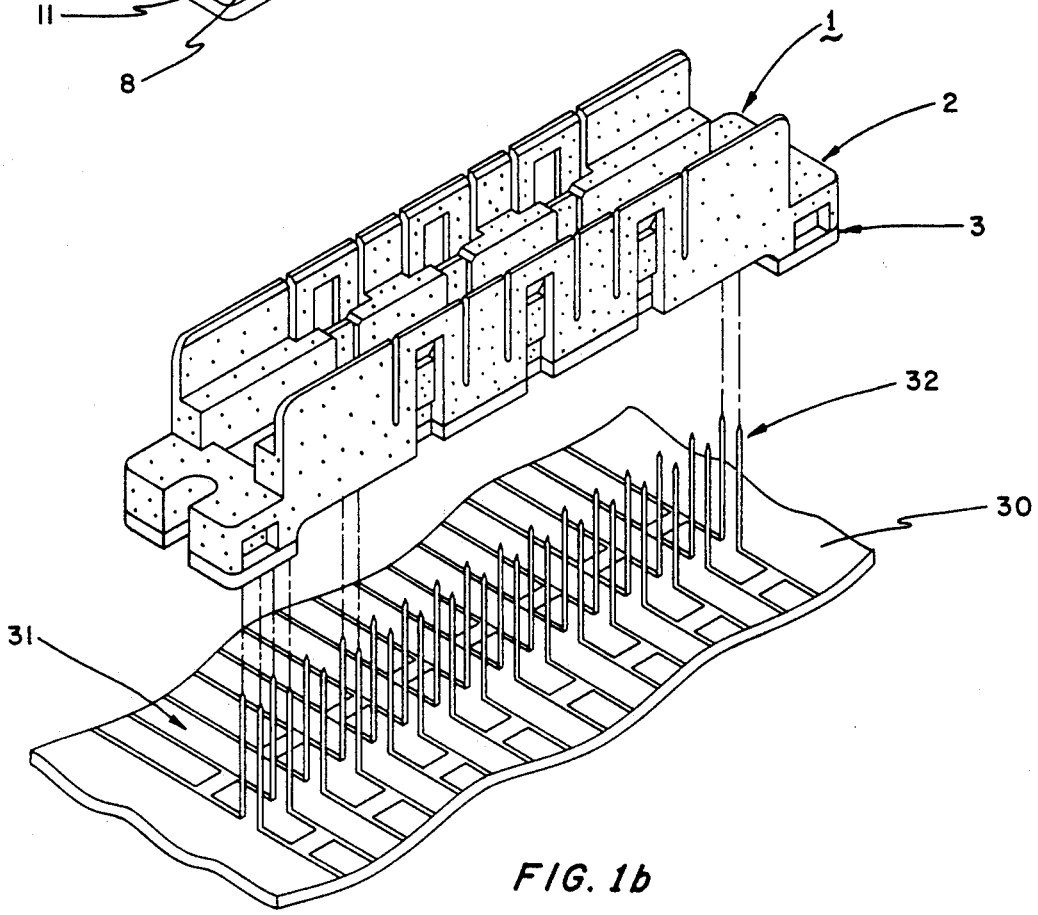

FIG. 1(*a*) shows a connector in accordance with the invention. As shown in the figure, the connector 1 may be generally separated into a socket portion 2 which requires surface treatment, and a base portion 3 which does not require any surface treatments. The socket portion 2 and the base portion 3 may be integrally molded with, for example, plastics. In order to prevent electromagnetic leak problems, the surface of the socket portion 2 is surface treated by electroplating or depositing metal vapor thereon.

The base portion 3 includes a long plate type terminal holder 4 which has: two arrays of terminal receiving holes 5 spaced apart at a predetermined distance from one another; legs 6 and 7 provided at the opposite ends of the terminal holder 4; board coupling members 8 and 9 provided on the legs 6 and 7; pins 10, 11, 12, and 13 provided on the board coupling members 8 and 9; and projections 14, 15, 16 and 17 projecting from the nearly central portion of the terminal holder 4.

The socket portion 2 has pin receivers 18 and 19 for receiving the pins 10, 11, 12, and 13 of the base portion holders 8 and 9, and wall members 24 and 25 which have projection receivers 20, 21, 22, and 23 for receiving therein the projections 14, 15, 16, and 17. The wall members 24 and 25 connect the pin receivers 18 and 19 and constitute together an outer surface of the connector 1.

In manufacturing a connector 1 having the above features, the socket portion 2 and the base portion 3 are formed separately, with the socket portion 2 subjected to metallic electroplating or metal vapor deposition for surface treatment. The socket portion 2 thus formed is aligned with the base portion 3 so as to enable the pins 10, 11, 12, and 13 and the projections 14, 15, 16, and 17 of the base portion 3 to be inserted in the respective receivers of the socket portion 2 to couple the socket portion 2 to the base portion 3.

A circuit board 30 having a printed circuit pattern 31 and two rows of terminals 32 spaced apart at predetermined distances and embedded in the patterns 31 as shown in FIG. 1(*b*) may be mounted on the connector 1 by inserting the terminals 32 into respective terminal receiving holes 5 of the base portion 3.

In this manner, the connector 1 may be manufactured much simpler in step compared with conventional ones, since the connector 1 consists of the socket portion 2 and the base portion 3 which is separately surface treated.

Figure 2A:
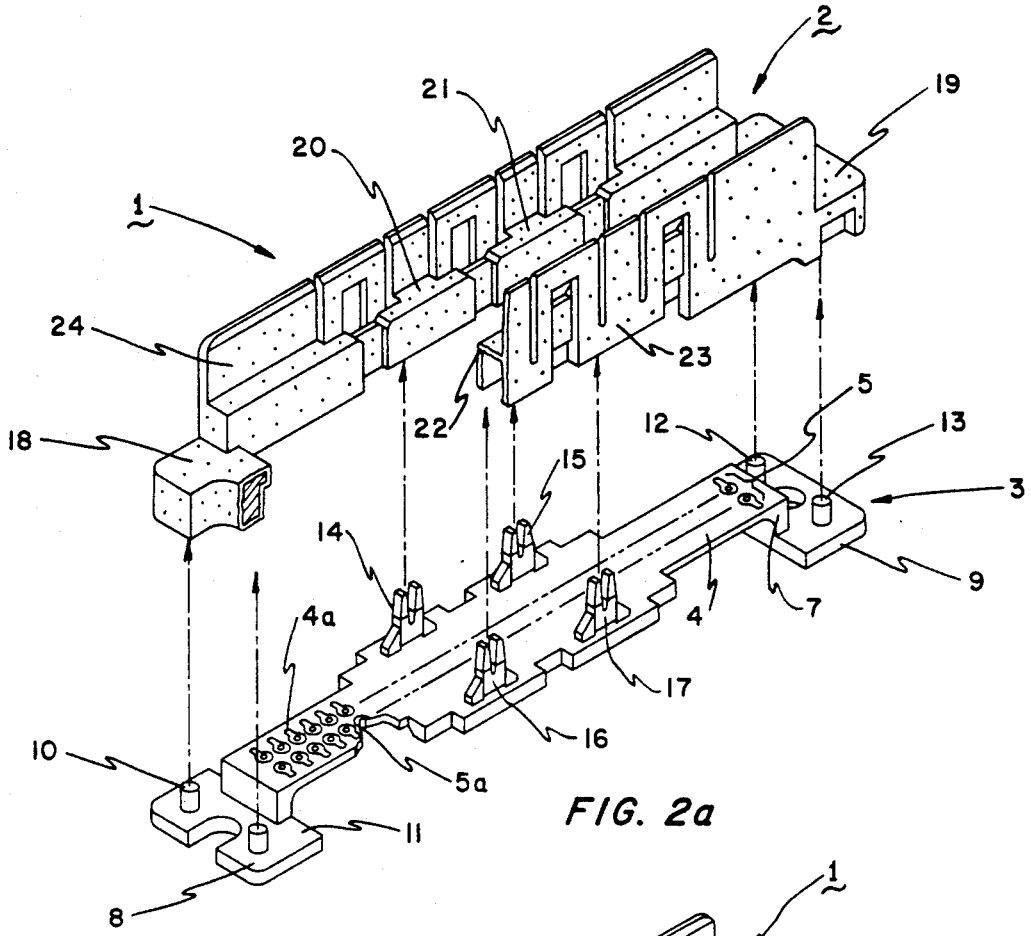
FIG. 2(*a*) is an exploded perspective view of another connector embodying the invention.
Figure 2B:
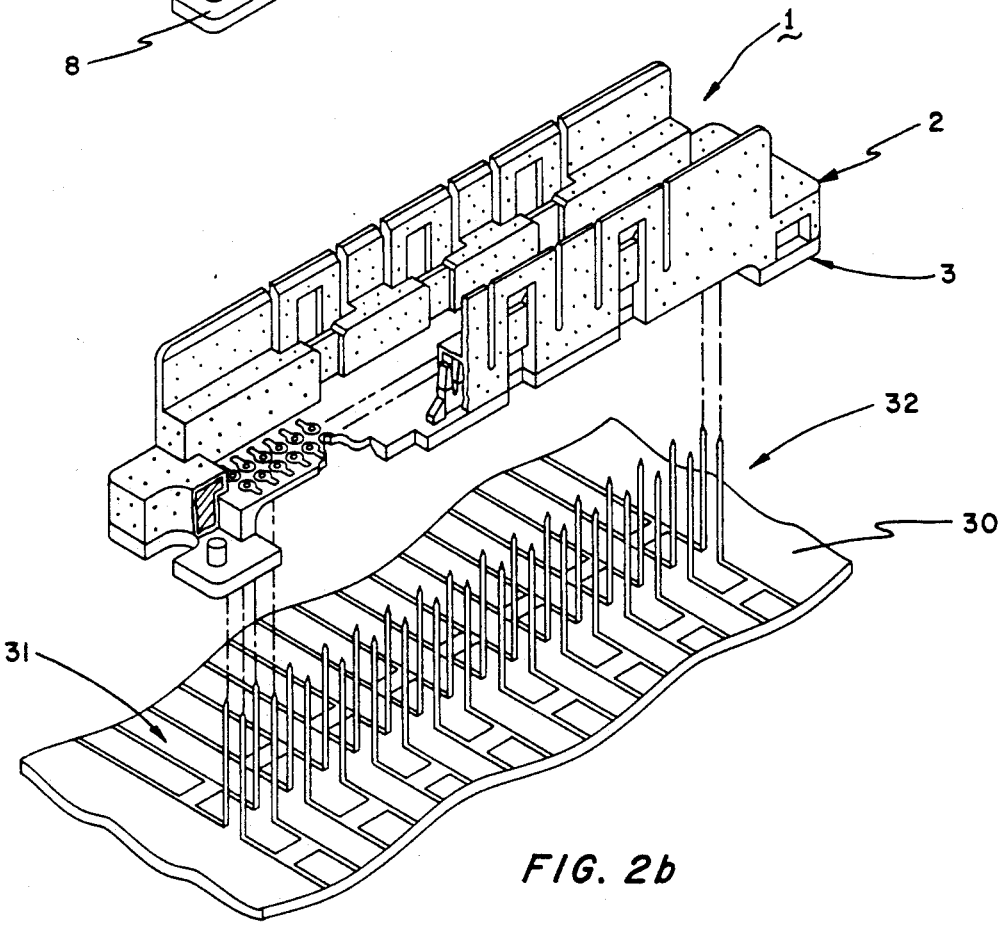

FIGS. 2 (*a*) and (*b*) show another example of a connector 1 according to the invention, in which portions similar to those shown in FIGS. 1 (*a*) and (*b*) are given the same reference numbers. As shown in FIGS. 2 (*a*) and (*b*), terminal receiving holes 5 are each given through-hole treatment 5*a*. A terminal holder 4 has a pattern 4*a* which constitutes a part of leads connected to a multi-layered circuit board.

In manufacturing the connector 1 having the above features, the socket portion 2 and a base portion 3 are formed separately, with the socket portion 2 subjected to metallic electroplating or metal vapor deposition for surface treatment, as in the same way as for the first example described above, and the terminal holder 4 is worked for through-hole processing 5*a* and surface treatment, e.g. etching, for forming the pattern 4*a*. The socket portion 2 thus formed is aligned with the base portion 3 so as to enable pins 10, 11, 12, and 13 and projections 14, 15, 16, and 17 of the base portion 3 to be inserted in the respective receivers of the socket portion 2 to couple the socket portion 2 to the base portion 3.

A circuit board 30 having a printed circuit pattern 31 and two rows of terminals 32 spaced apart at predetermined distances and embedded in the pattern 31 as shown in FIG. 2(*b*) may be mounted on the connector 1 by inserting the terminals 32 into respective terminal receiving holes 5 of the base portion 3.

In this manner, the connector 1 may be manufactured much simpler in step compared with conventional ones, since the connector 1 consists of the socket portion 2 and the base portion 3 which may be separately surface treated.

It should be understood that, although a connector of the invention is described only for those suitable for two kinds of surface treatments in the above description, the invention may be applied equally well to other cases involving three or more different surface treatments.

We claim:

1. A connector comprising:

a first portion subjected to surface treatment and composed of a pair of wall members and a pair of pin receivers for joining said pair of wall members to each other, each of said wall members having at least one projection receiver and said each of said pin receivers having at least one hole; and a second portion having no surface treatment and being provided separately from said first portion, said second portion being composed of a terminal holder of a long plate type, a pair of legs provided at both end portions of said terminal holder, and a pair of board coupling members provided on said pair of legs, each of said board coupling members having at least one pin which is to be coupled to said hole of a corresponding one of said pin receivers, and said terminal holder having at least two projections, each of which is to be coupled to said projection receiver of a corresponding one of said wall members and wherein said terminal holder further has a plurality of terminal receiving holes to be connected to terminal pins provided on a circuit board, each of said terminal receiving holes being subjected to through-hole treatment;

wherein said first and second portions are coupled to each other by couplings between said pin and said hole of said pin receiver and between said projection and said projection receivers.

2. The connector as claimed in claim 1, wherein each pin receiver further has at least an additional hole, each of said wall members further having an additional two projection receivers, each of said board coupling members further having an additional pin, said terminal holder further having an additional two projections, said additional pin and said additional hole being coupled to each other, and said additional two projections and said additional two projection receivers being coupled respectively to each other.

3. The connector as claimed in claim 1, wherein said plurality of terminal receiving holes are arranged in two lines.

* * * * *